United States Patent [19]

Longarzo

[11] Patent Number: 5,026,190

[45] Date of Patent: Jun. 25, 1991

[54] DUAL WRITING ELEMENT RETRACTABLE PEN

[75] Inventor: Roland Longarzo, Valley Stream, N.Y.

[73] Assignee: 2C Co. Corp., New York, N.Y.

[21] Appl. No.: 412,344

[22] Filed: Sep. 26, 1989

[51] Int. Cl.[5] ..... B43K 27/00

[52] U.S. Cl. ..... 401/30; 401/29; 401/31; 401/32

[58] Field of Search ..... 401/29, 30, 31, 32, 401/33

[56] References Cited

U.S. PATENT DOCUMENTS

| | | | |
|---|---|---|---|
| 3,816,006 | 6/1974 | Tailer | 401/30 |
| 4,533,271 | 8/1985 | Sansevero | 401/29 |
| 4,738,557 | 4/1988 | Yumoto | 401/30 |

FOREIGN PATENT DOCUMENTS

| | | | |
|---|---|---|---|
| 197804 | 10/1976 | Fed. Rep. of Germany | 401/30 |
| 7509286 | 8/1975 | Netherlands | 401/30 |
| 2143781 | 2/1985 | United Kingdom | 401/29 |

*Primary Examiner*—Robert A. Hafer
*Assistant Examiner*—Kerry Owens
*Attorney, Agent, or Firm*—Howard C. Miskin

[57] ABSTRACT

A dual writing element retractable pen includes coaxial upper and lower barrel members, an upper cylindrical cam part being integrally formed with the upper barrel member and having a bottom cam surface. A matching lower cylindrical cam part telescopes the upper barrel member and is oriented so that the confronting end faces of the cam parts delineate a cam groove having opposite oppositely inclined sections. A rotatable guide member longitudinally slideably supports pen cartridge coupled chucks having followers engaging respective cam groove sections, the guide member being coaxial with the barrel. In one form, the lower cam member is integrally formed with the lower barrel member and, in another form, the lower cam and barrel members are an integrally molded unit and the guide member terminates in an external finger knob.

27 Claims, 5 Drawing Sheets

DUAL WRITING ELEMENT RETRACTABLE PEN

BACKGROUND OF THE INVENTION

The present invention relates generally to improvements in writing instruments and it relates particularly to an improved multiple element writing instrument in which the writing elements may be selectively advanced to a writing position.

Protract retract dual writing element pens of the twist type are well known and widely employed. Such pens conventionally include a pair of manually accessible control components, one being a cylindrical cam and the other a longitudinal guide member and writing element engaging chucks which are restricted to longitudinal movement by the guide member having followers engaging the cam to effect such longitudinal movement of the chucks and writing elements with the relative rotation or twisting of the control components which alternatively effects the advance of a selected one of the writing elements and the withdrawal of the other.

The aforesaid twist type dual writing element is highly convenient to use but is generally complicated and expensive, requiring a large number of separate parts many of which are costly and a time consuming and laborious assembly calling for highly skilled labor. The conventional and known twist type dual element retractable pen is by reason of its complexity and cost unsuitable for use as a disposable or throw-away article.

SUMMARY OF THE INVENTION

A principal object of the present invention is the provision of an improved writing instrument.

Another object of the present invention is the provision of an improved retractable pen.

Still another object of the present invention is to provide an improved twist type retractable pen.

A further object of the present invention is to provide an improved multiple element twist type retractable pen in which the individual writing elements are selectively protractable.

Still a further object of the present invention is to provide an improved multiple writing element retractable pen comprising a minimum of components which are easily and rapidly assembled with little skill and each of which is easily moldable of a thermoplastic polymeric material to provide a rugged, reliable, and inexpensive device of attractive appearance and cheap enough to be disposable or a throw-away or giveaway.

The above and other objects of the present invention will become apparent from a reading of the following description taken in conjunction with the accompanying drawings which illustrate preferred embodiments thereof.

A retractable multiple writing element pen in accordance with the present invention includes axially coupled upper and lower barrel members, the upper barrel member having integrally formed on its inside face a first cylindrical cam portion having along its bottom a peripherally longitudinally inclined top cam surface. A second cam portion has a top face defining a bottom cam surface complementing, parallel to and spaced from the top cam surface to delineate a cylindrical cam track or groove including oppositely axially peripherally inclined cam groove sections. The second cam portion telescopes the upper barrel section with an interference fit and a mating longitudinal ridge and groove are formed in the confronting faces of the second cam and upper barrel member to precisely index and orient the top and bottom cam surfaces. A guide member having opposite longitudinal channels is rotatably axially positioned in the barrels and a writing element engaging chuck slidably engages each longitudinal channel and includes a transverse follower slidably engaging the cam groove. A writing element engages each of the chucks and extends toward the apertured tapered tip of the lower barrel member.

In one preferred embodiment of the improved pen, the guide member rotatably engages an axial bore in the upper part of the upper barrel member and extends into and is coupled to the lower barrel member to be rotatable therewith so that relative twisting of the upper and lower barrel members effects the advance and withdrawal of respective writing elements. In another preferred embodiment of the present invention, the lower cam section is integrally formed as a unit with the lower barrel member and the guide member terminates at its top in an enlarged head or knob to facilitate the manual turning of the guide member relative to the barrel to effect the writing element advance and withdrawal movements.

The improved multiple element retractable pen, in addition to the writing elements, per se, includes only five or six individual parts, each of which is molded as a single unit, of a thermoplastic or thermosetting organic polymeric resin composition, the component parts are easily and rapidly assembled, the parts interfitting and indexing formations being integrally formed on the respective components. Moreover, springs and other elements are obviated. The resulting writing instrument is rugged, reliable, simple, easily decorated and of attractive appearance and of low final cost permitting its use as a disposable giveaway and throwaway article.

DESCRIPTION OF THE PREFERRED EMBODIMENTS

Figure 1:
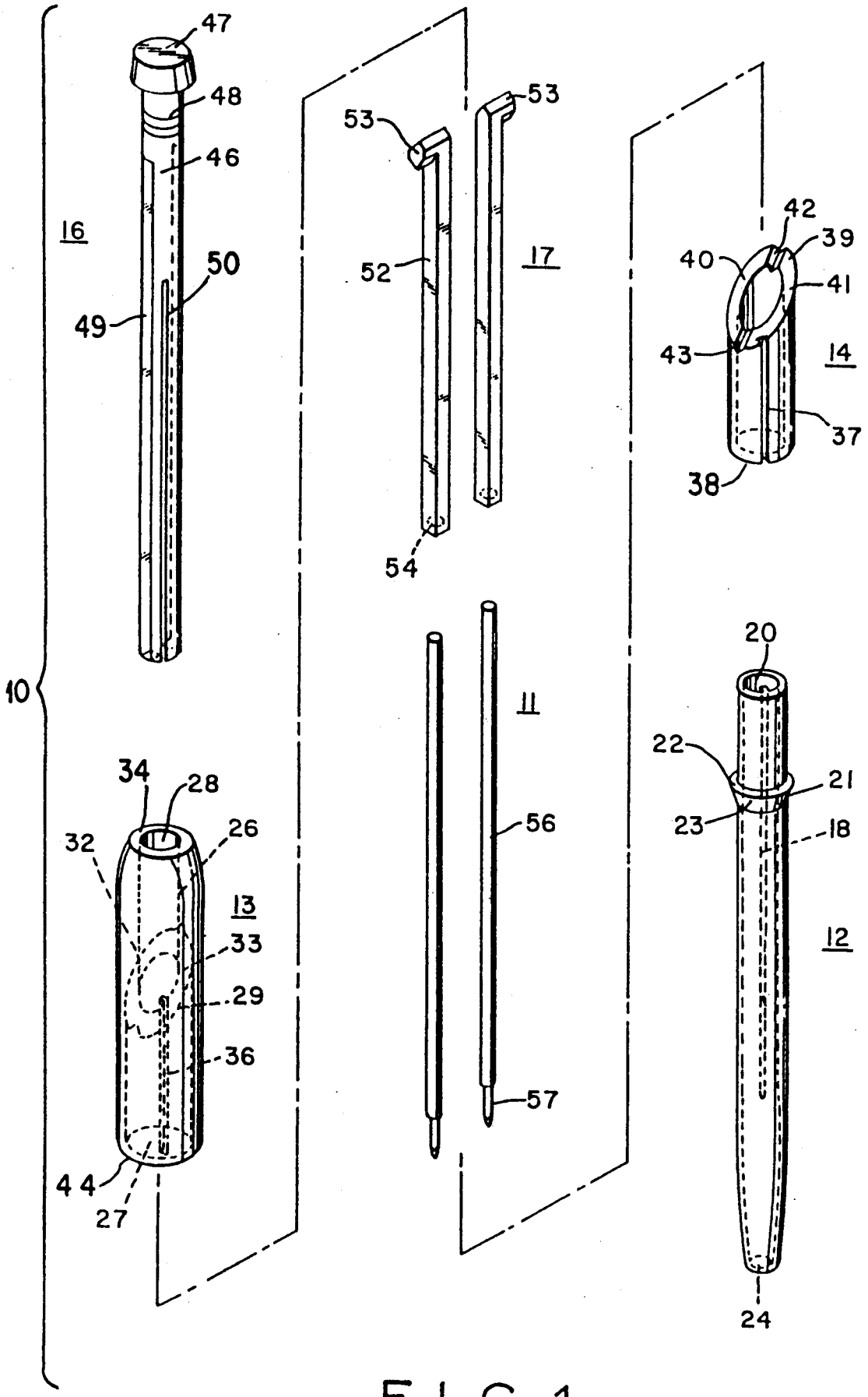
FIG. 1 is an exploded perspective view of a preferred embodiment of the present invention.
Figure 2:
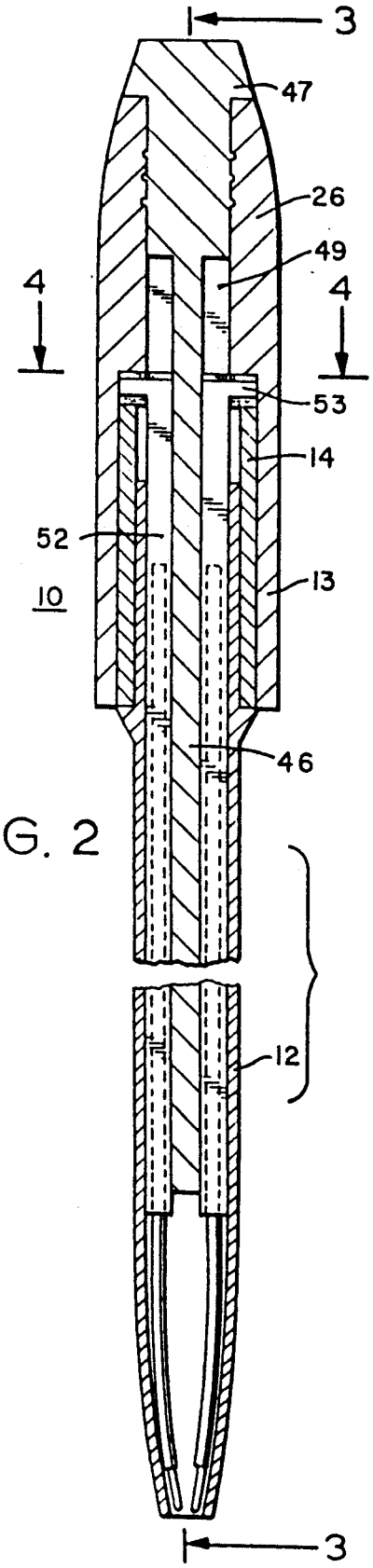
FIG. 2 is a longitudinal sectional view of the assembled writing instrument shown in FIG. 1 with the writing elements in retracted position.

Referring to the drawings, particularly FIGS. 1 to 7 thereof which illustrate a preferred embodiment of the present invention, the reference numeral 10 generally designates the improved pen which is shown as a twist type retractable dual writing element instrument. The pen 10 in addition to a pair of different writing elements 11 of conventional construction which may be different colored ink ball or other point cartridges, a lower barrel member 12, an upper barrel member 13, a lower cylindrical cam second part or section 14, a longitudinal guide member 16 and a pair of similar chuck members 17. Each of the components 12–17 is an integrally formed unit molded of a synthetic organic polymeric resin of any suitable composition which may be thermoplastic or thermosetting.

The lower barrel member 12 is mostly of tubular cylindrical shape open at its top and tapering at its bottom portion to a writing element circular bottom access opening 24. Formed on the inside face 20 of barrel member 12 is an indexing formation or ridge 18 which extends longitudinally from proximate the top of barrel member 12 to a point shortly above the tapered bottom portion of barrel member 12. Formed on the upper outside face of barrel member 12 a short distance below its top opening 20 is a collar 21 having a horizontal flat shoulder defining top face 22 and a downwardly inwardly tapering peripheral face 23.

The upper barrel member 13, in accordance with the present invention, has integrally formed therewith on its upper inside face the upper section or first part 26 of a cylindrical cam. Upper barrel member 13 is of tubular configuration with an inside diameter approximately equal to the outside diameter of collar shoulder 22 and having a circular bottom opening 27 of diameter about equal to that of shoulder 22. Cam upper section 26 has an axial bore 28 and a downwardly facing top cam face or cam surface defining bottom face 29. Cam surface 29 is substantially planar and includes 180 degree oppositely inclined cam surface sections 32 and 33, cam surface section 32 being axially counterclockwise downwardly inclined and section 33 being axially clockwise downwardly inclined; the cam surface section each extending peripherally approximately 180 degrees. Barrel member 13 terminates at its top in a flat transverse annular end face 34.

Formed on the lower inside face of upper barrel member 13 and extending from the lower edge thereof to a level below the cam surface 29 is a longitudinally extending indexing formation or ridge 36.

The lower cylindrical cam section 14 is of circular cylindrical tubular shape with an outside diameter slightly greater than the inside diameter of the lower portion of upper barrel member 13. A longitudinal indexing formation or groove 37 matching in dimensions and position the rectangular indexing ridge 36 is formed in the outside peripheral face of cam section 14. The bottom end face 38 of cam section 14 is planar and horizontal and the top end face 39 thereof which defines a bottom cam face and is flat and inclined at the angle of the bottom end face 29 of upper cam section 26 to provide a pair of oppositely inclined cylindrical cam faces 40 and 41 corresponding to cam surfaces 32 and 33. The tops and bottoms respectively of cam surfaces 40 and 41 terminate in radial triangular top and bottom vertical notches 42 and 43.

Cam section 14 telescopes and is contiguous to the enlarged lower portion of barrel member 13 with a relative movement preventing fit, such as an interference or force fit, the indexing ridge 36, engaging indexing groove 37 and cam section end face 38 being coplanar with the bottom end face 44 of barrel member 13. As angularly indexed by ridge 36 and groove 37 and relatively positioned by end faces 38 and 44, cam surfaces 40 and 41 are in vertically spaced registry with and equally spaced from and parallel to cam surfaces 32 and 33, the cam surfaces delineating a cylindrical cam track or groove of uniform height including opposite oppositely inclined 180-degree cam groove sections. It should be noted that the inclined cam groove sections may be less than 180 degrees each.

The guide member 16 includes an elongated circular cylindrical rod 46 terminating at its top in an enlarged frusto-conical head 47 with a flat annular underface, the peripheral face of rod 46 shortly below head 47 having axially spaced annular ridges 48. Formed in opposite sides of the peripheral face of rod 46 are 180-degree spaced longitudinal guide channels or tracks 49 of square transverse cross section extending from shortly below ridges 48 to the bottom end of rod 46. Also formed in the outside face of rod 46 is a longitudinally extending groove 50 extending upwardly from the bottom of rod 46 and located between channels 49 and mating ridge 18 on the inside face of barrel member 12. In the assembled condition of pen 10, rod 46 rotatably engages bore 28 in barrel member 13 and the axial bore in cam section 14 and tightly engages the bore in barrel member 12 with ridge 18 engaging groove 50 so that barrel member 12 and guide member 16 rotate in unison. The underface of head 47 engages end face 34 of barrel member 13.

Each chuck member 17 includes an elongated bar 52 slidably engaging and nesting in a respective guide channel 49. The bar 52 terminates at its top in an integrally formed transversely projecting follower 53 of hexagonal transverse cross section with a lowermost angle, each follower 53 slidably engaging a respective cam groove section delineated by cam surfaces 32, 33, 40 and 41 at 180 degree spaced points. A cylindrical coupling socket 54 is formed in the lower end of each bar 52.

A pen or other writing element 11 of known construction includes a tubular reservoir 56 and terminates at its bottom in a writing tip 57. The upper end of each writing element tightly fits in a respective coupling socket 54 so that the writing elements are movable with their corresponding chuck members.

Figure 3:
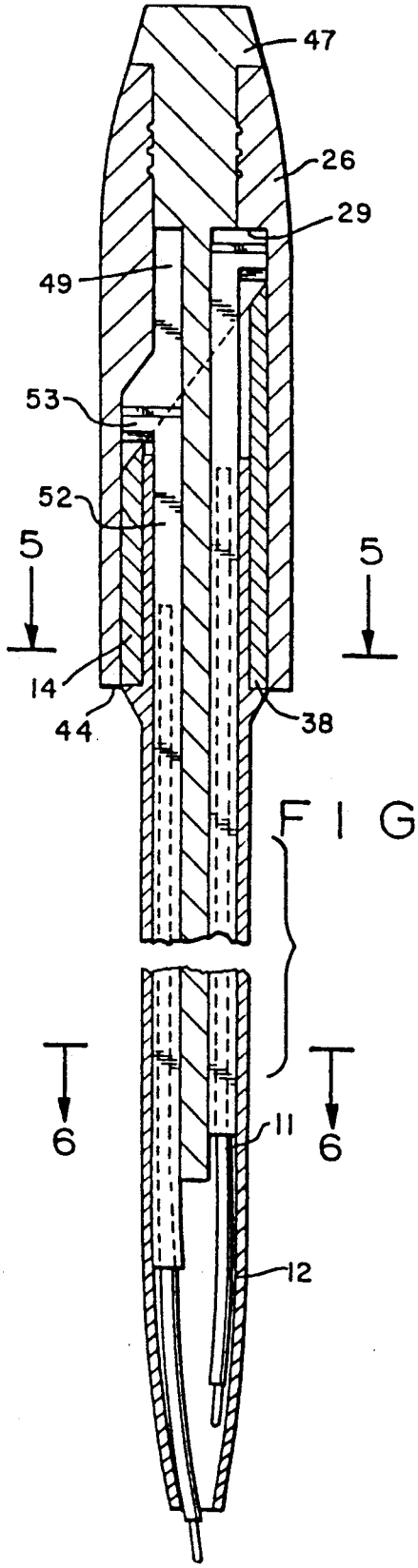
FIG. 3 is a sectional view taken along line 3—3 in FIG. 2 but with one writing element shown retracted and the other protracted.
Figure 4:
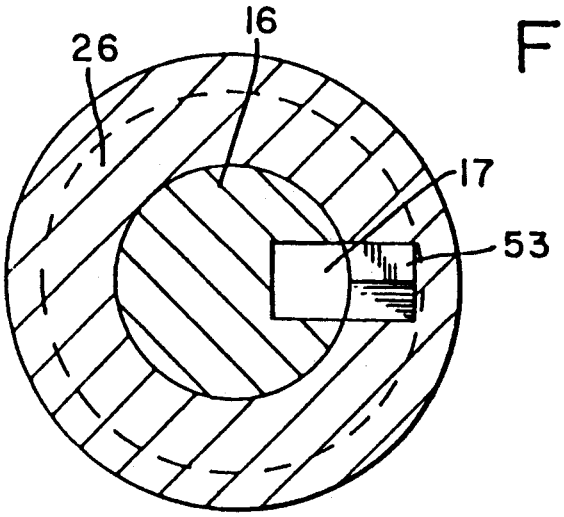
FIG. 4 is a sectional view taken along line 4—4 in FIG. 2.
Figure 5:
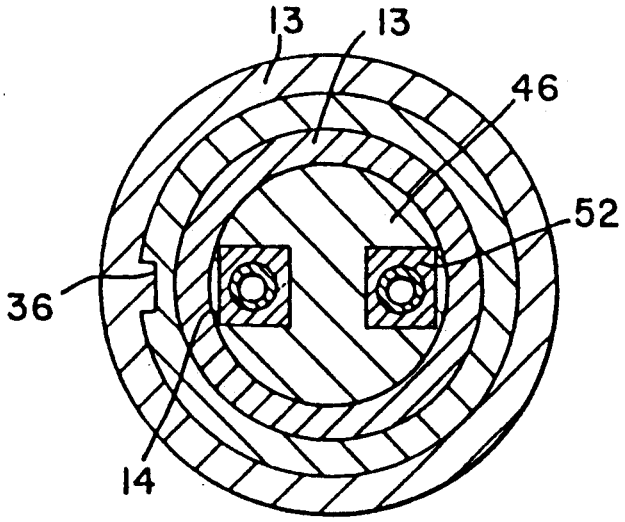
FIG. 5 is a sectional view taken along line 5—5 in FIG. 3.
Figure 6:
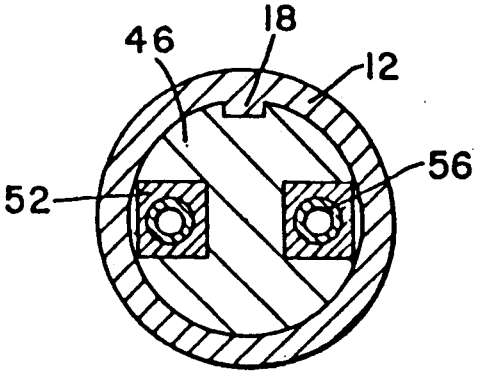
FIG. 6 is a sectional view taken along line 6—6 in FIG. 3.
Figure 7:
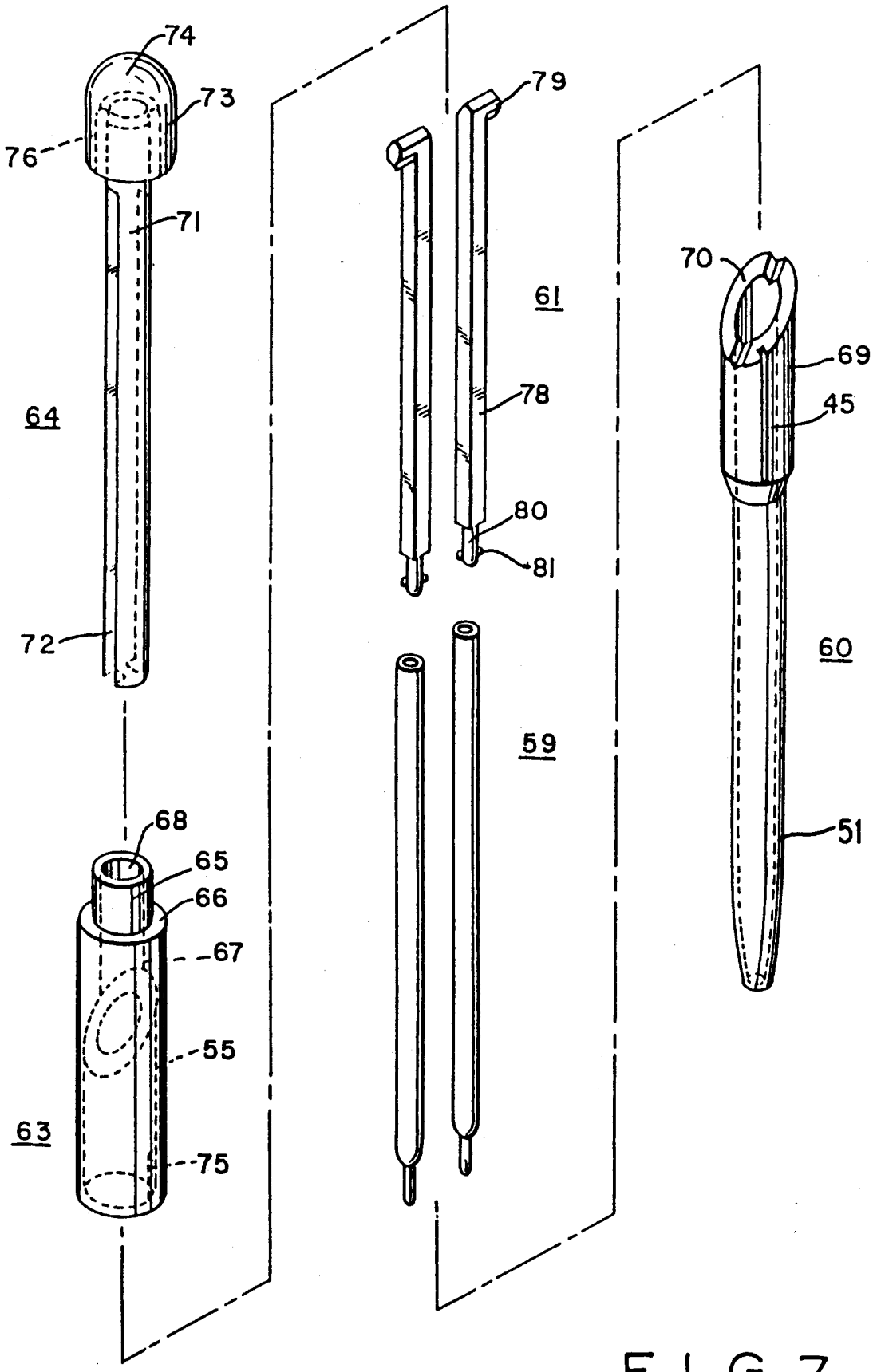
FIG. 7 is an exploded perspective view of another preferred embodiment of the present invention.
Figure 8:
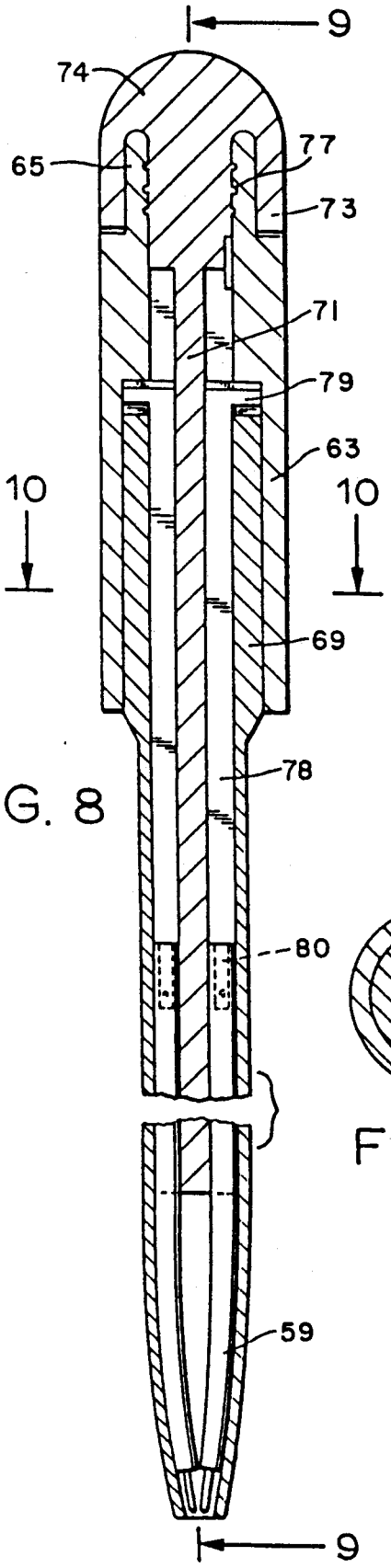
FIG. 8 is a medial longitudinal sectional view of the assembled pen of the embodiment of FIG. 7 with the writing elements in retracted positions.
Figure 10:
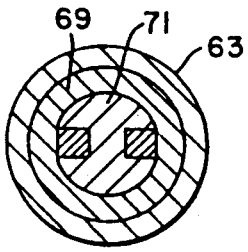
FIG. 10 is a sectional view taken along line 10—10 in FIG. 8.
Figure 9:
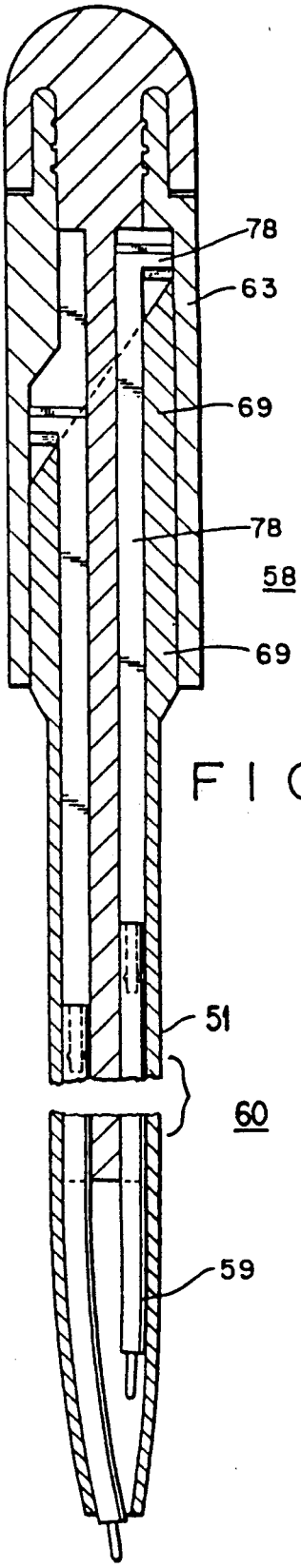
FIG. 9 is a sectional view taken along line 9—9 in FIG. 8.

In assembling the pen 10, guide member rod 46 is inserted through upper barrel bore 28 to bring head 47 to bear on barrel end face 34. The writing element carrying chuck bars are then slid along respective guide channels 49 to bring followers 53 into engagement with upper cam surfaces 32 and 33 and thereafter cam member 40 is telescoped into barrel member 13 as angularly positioned by engaging indexing ridge 36 and groove 37. Cam member 14 is force raised in barrel member 13 by a suitable die until the bottom face of cam member 14 is coplanar with the bottom edge of barrel member 13 in which position the cam surfaces delineate a suitably wide cam channel. The upper portion of the bottom barrel member 12 is then inserted into the bore of cam member 14 until shoulder 22 engages the bottom thereof, the lower part of guide member rod 46 telescoping the upper part of barrel member 12 with ridge 18 engaging guide member channel 50 so that the guide and lower barrel members rotate in unison. The pen and writing elements are so dimensioned that when the followers 53 engage midpoints on the respective cam channel sections both elements 11 are withdrawn into barrel 12 as show in FIG. 2, and when one follower 53 engages the upper end, the other follower 53 simultaneously engages the lower end of the corresponding cam channel section so that one writing element is fully retracted and the other writing element is fully protracted as shown in FIG. 3.

In the operation of pen 10 by relatively twisting upper and lower barrel members 12 and 13, the guide member 16 angularly shifts chucks 17 which are longitudinally shifted in opposite directions by the interaction of followers 53 and the respective cam channel sections. Thus, relatively twisting the barrel members in one directions withdraws a first of the writing elements and advances the other writing element to its protracted writing position and twisting the barrel members in an opposite direction advances the first writing element to writing position and withdraws the other. Twisting the barrel members to an intermediate angular position brings both writing elements into a withdrawn position within the lower barrel member.

The embodiment of the present invention illustrated in FIGS. 7 to 10 of the drawings differs from that first described primarily in that the lower cam member and lower barrel section are integrally formed as a unit and the guide member is rotatable relative to the upper and lower barrel members thereby reducing the number of individually molded components.

Specifically, the improved modified pen is designated by the reference numeral 58 and includes, in addition to the ball point pen cartridges 59, a lower barrel and cam section unit 60, a pair of chuck members 61, an upper barrel and cam section member 63 and a guide member 64.

Upper barrel member 63 is of cylindrical tubular configuration including a main body portion 55 and an upper coaxial tubular stub portion 65 separated from main portion 55 by flat annular shoulder 66. Integrally formed on the inside face of body portion 55 is an upper cam section 67 similar in shape to cam section 26 of the first embodiment, cam section 67 and stub 65 having a common axial bore 68. A short longitudinal indexing ridge member 75 is formed on the lower inside face of main portion 55.

The lower barrel and cam section 60 corresponds in shape to the assembled lower barrel member 12 and cam member 14 of the first described embodiment but integrally molded as a single unit. Lower barrel member 60 includes a bottom lower barrel section 51 similar to that of barrel member 12 and an upper portion 69 defining a lower cylindrical cam section corresponding to cam section 40 and having an inclined top cam face 70 corresponding to cam face 40. It should be noted that the internal longitudinal ridge 18 in barrel member 12 is here obviated. Formed on the outside peripheral face of cam section 69 is a longitudinal indexing groove 45.

The guide member 64 includes an elongated cylindrical rod 71 having formed in opposite sides thereof track defining channels 72 of rectangular transverse cross section and extending from the bottom of rod 71 to a level a little short of the top thereof. Formed atop the rod 71 is a cup shaped coaxial cylindrical knob 73 having a hemispherical top wall 74, the inside peripheral face of knob 73 being radially spaced from the peripheral face of rod 71 to define an annular recess 76. In the assembled condition of guide member 64 and upper barrel member 63, the upper part of rod 71 rotatably engages bore 68 and stub 65 rotatably nests in annular recess 76, mating peripheral ridges and grooves 77 being formed in the confronting engaging faces of stub 65 and the upper part of rod 71 to prevent any axial relative movement while permitting the rotation of guide member 64.

Each chuck member 61 includes a bar of rectangular transverse cross section 78 and slidably engages a respective guide channel 72. The guide bars 78 terminate at their top in an outwardly transversely projecting follower 79 of hexagonal transverse cross section. A coupling pin 80 axially depends from each bar 78 and each has formed on its outer face a pair of opposite detents 81. Pins 80 project into the open top ends of respective tubular writing elements 59 and are retained thereon by detentes 81.

In assembling pen 58, guide member 64 is advanced downwardly through bore 68 to bring stub 65 into engagement with annular recess 76 and locked therein against axial movement, the underface of knob 73 bearing on shoulder 66. A writing element coupled chuck member 61 is brought into sliding engagement with each guide channel 72 and raised to bring the follower 79 thereon into engagement with the bottom cam face of upper cam section 67. The lower cam section 69 is advanced upwardly in telescoping engagement with the lower inside face of cam section 67 and with indexing groove 45 and ridge 75 in sliding engagement. The lower barrel member 60 is then raised until the lower outer peripheral edge of cam section 69 is at the level of the bottom edge of upper barrel member 63 in which position the cam faces of the upper and lower cam sections delineate a cylindrical cam channel with opposite differently inclined sections which are slidably engaged by respective followers 79. The confronting peripheral faces of the upper and lower cam sections are in relative movement preventing fit, for example an interference or force fit.

The operation of the pen last described is similar to that first described.

Whiled there have been described and illustrated preferred embodiments of the present invention, it is apparent that numerous alterations, omissions and additions may be made without departing from the spirit thereof.

I claim:

1. A writing instrument comprising:

an upper barrel member having integrally formed on its upper inside face a cylindrical cam first part having along its bottom a top cam face;

a separate cylindrical cam second part telescoping and contiguous to the lower part of said upper barrel member and having along its top a bottom cam face complementing said top cam face and positioned and oriented relative to said top cam face to delineate a cylindrical cam track including peripherally spaced oppositely longitudinally peripherally inclined cam track sections, said upper barrel member and said cylindrical cam second part having confronting peripheral faces in mutual interference engagement;

a longitudinal guide member coaxial with and rotatable relative to said cam track and including a pair of peripherally space longitudinal guide tracks;

a chuck member slidably engaging each of said guide tracks and including a follower projecting transversely into sliding engagement with a respective cam track section;

a lower barrel member depending from and coaxial with said upper barrel member and terminating at its bottom end in an axial aperture; and a writing element engaging and movable with each of said chucks and extending downwardly toward said lower barrel member bottom end.

2. The writing instrument of claim 1 wherein said guide member is coupled to and rotatable with said lower barrel member.

3. The writing instrument of claim 1 wherein said cylindrical cam second part is integrally formed with said lower barrel member as a unitary member.

4. The writing instrument of claim 3 wherein said upper barrel member has an axial bore formed in its upper part and said guide member includes a cylindrical rod rotatably engaging said upper barrel member bore and terminating at its top in a control knob.

5. The writing instrument of claim 4 wherein said upper barrel member has an upwardly projecting sleeve coaxially formed at its top and said knob has a coaxial open bottom annular socket formed in its underface rotatably engaging said sleeve.

6. The writing instrument of claim 1 wherein said guide tracks are defined by channels of rectangular transverse cross section and each of said chuck members include a rectangular bar slidably engaging a respective guide channel.

7. The writing instrument of claim 1 wherein each of said cam track sections extends for approximately 180 degrees.

8. The writing instrument of claim 7 wherein the lower ends of the bottom faces of said cam track sections are joined by a vertical notch.

9. A dual selectively protractable writing element writing instrument comprising:

a tubular first barrel member;

a cylindrical cam coaxially locate in said barrel member and having a cylindrical cam groove with opposite oppositely inclined cam groove sections, defined by parallel axially opposite faces;

a longitudinally stationary rotatable guide member coaxial with said cylindrical cam and having formed therein a pair of peripherally opposite longitudinally extending guideways;

a chuck member slidably engaging each of said guideways and including a transversely projection follower slideably engaging a respective cam groove section; and a writing element coupled to each of said chucks;

said writing instrument being characterized by said cylindrical cam including axially spaced coaxial first and second cam parts with said cam groove faces being defined by the confronting spaced end faces of said cam parts, said first cam part being integrally formed with said barrel member and said second cam part telescoping and being contiguous to said first barrel member, said second cam part and said barrel member having confronting peripheral faces in mutual interference engagement.

10. The writing instrument of claim 1 wherein said upper barrel member and said cylindrical cam second part have confronting peripheral faces in mutual interference engagement.

11. The writing instrument of claim 10 including a second barrel member coaxial with said first barrel member and integrally formed as a unit with said second cam part.

12. The writing instrument of claim 11 wherein said guide member projects axially through and is rotatable relative to said first barrel member and terminates in a knob located at the outer end of said first barrel member.

13. The writing instrument of claim 9, including a second barrel member coaxial with said first barrel member and coupled to said guide member for rotation therewith.

14. The writing instrument of claim 10 wherein said second cam part and said barrel member having confronting peripheral faces in mutual interference engagement.

15. A writing instrument comprising:

an upper barrel member having integrally formed on its upper inside face a cylindrical cam first part having along its bottom a top cam face;

a cylindrical cam second part telescoping the lower part of said barrel member and having along its top a bottom cam face complementing said top cam face and positioned and oriented relative to said top cam face to delineate a cylindrical cam track including a peripherally spaced oppositely longitudinally peripherally inclined cam track sections, the confronting telescoping faces of said upper barrel member and cam second part having mating indexing formations positioning said upper barrel member and said second cam part in a predetermined relative angular relationship wherein said upper and lower cam faces are parallel and equidistant;

a longitudinal guide member coaxial with and rotatable relative to said cam track and including a pair of peripherally space longitudinal guide tracks;

a chuck member slidably engaging each of said guide tracks and including a follower projecting transversely into sliding engagement with a respective cam track section;

a lower barrel member depending from and coaxial with said upper barrel member and terminating at its bottom end in an axial aperture; and a writing element engaging and movable with each of said chucks and extending downwardly toward said lower barrel member bottom end.

16. A dual selectively protractable writing element writing instrument comprising:

a tubular first barrel member;

a cylindrical cam coaxially locate in said barrel member and having a cylindrical cam groove with opposite oppositely inclined cam groove sections, defined by parallel axially opposite faces;

a longitudinally stationary rotatable guide member coaxial with said cylindrical cam and having formed therein a pair of peripherally opposite longitudinally extending guideways;

a chuck member slidably engaging each of said guideways and including a transversely projection follower slideably engaging a respective cam groove section; and a writing element coupled to each of said chucks;

said writing instrument being characterized by said cylindrical cam including axially spaced coaxial first and second cam parts with said cam groove faces being defined by the confronting spaced end faces of said cam parts, said first cam part being integrally formed with said barrel member and said second cam part having mating indexing formations to provide a predetermined angular relationship between said first and second cam parts.

17. The writing instrument of claim 15 wherein said guide member is coupled to and rotatable with said lower barrel member.

18. The writing instrument of claim 15 wherein said cylindrical cam second part is integrally formed with said lower barrel member as a unitary member.

19. The writing instrument of claim 18 wherein said upper barrel member has an axial bore formed in its upper part and said guide member includes a cylindrical rod rotatably engaging said upper barrel member bore and terminating at its top in a control knob.

20. The writing instrument of claim 19 wherein said upper barrel member has an upwardly projecting sleeve coaxially formed at its top and said knob has a coaxial open bottom annular socket formed in its underface rotatably engaging said sleeve.

21. The writing instrument of claim 14 wherein said guide tracks are defined by channels of rectangular transverse cross section and each of said chuck members includes a rectangular bar slideably engaging a respective guide channel.

22. The writing instrument of claim 14 wherein each of said cam track sections extends for approximately 180 degrees.

23. The writing instrument of claim 22 wherein the lower ends of the bottom faces of said cam track sections are joined by a vertical notch.

24. The writing instrument of claim 16, the confronting peripheral faces of said first barrel member and said second cam part having mating indexing formations to provide a predetermined angular relationship between said first and second cam parts.

25. The writing instrument of claim 24 including a second barrel member coaxial with said first barrel member and integrally formed as a unit with said second cam part.

26. The writing instrument of claim 25 wherein said guide member projects axially through and is rotatable relative to said first barrel member and terminates in a knob located at the outer end of said first barrel member.

27. The writing instrument of claim 16, including a second barrel member coaxial with said first barrel member and coupled to said guide member for rotation therewith.

* * * * *